United States Patent [19]

Carlini

[11] 4,265,592

[45] May 5, 1981

[54] CENTRIFUGAL FAN

[76] Inventor: Gerardo P. V. Carlini, Gavilan 4552, Buenos Aires, Argentina

[21] Appl. No.: 37,454

[22] Filed: May 9, 1979

[51] Int. Cl.[3] ..... F04D 27/00

[52] U.S. Cl. ..... 415/157; 406/97

[58] Field of Search ..... 415/151, 157, 159, 206; 406/97

[56] References Cited

U.S. PATENT DOCUMENTS

| | | | |
|---|---|---|---|
| 1,053,154 | 2/1913 | Campbell | 415/157 |
| 1,834,959 | 12/1931 | May | 415/157 |
| 1,893,710 | 1/1933 | Lykken | 406/97 |

*Primary Examiner*—Billy J. Wilhite

*Attorney, Agent, or Firm*—Michael J. Striker

[57] ABSTRACT

The centrifugal fan comprises a casing having a cylindrical jacket with a tangentially directed outlet duct and lateral walls, one of the walls being formed with an axially directed inlet duct partially projecting into the casing, an impeller wheel supported for rotation in the casing opposite the opening of the inlet duct, and axially displaceable tubular partition coaxially surrounding the inlet duct and projecting into the casing toward the face of the impeller wheel to define therewith a variable gap which connects an adjustable diffusing antechamber resulting in the casing between the displaceable tubular partition and the inlet duct to a main diffusing chamber resulting between the displaceable tubular partition and the cylindrical jacket.

5 Claims, 6 Drawing Figures

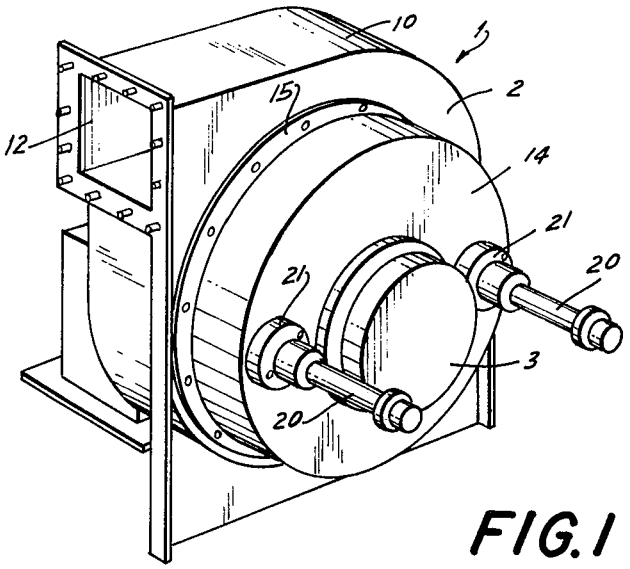
FIG. 1
FIG. 2
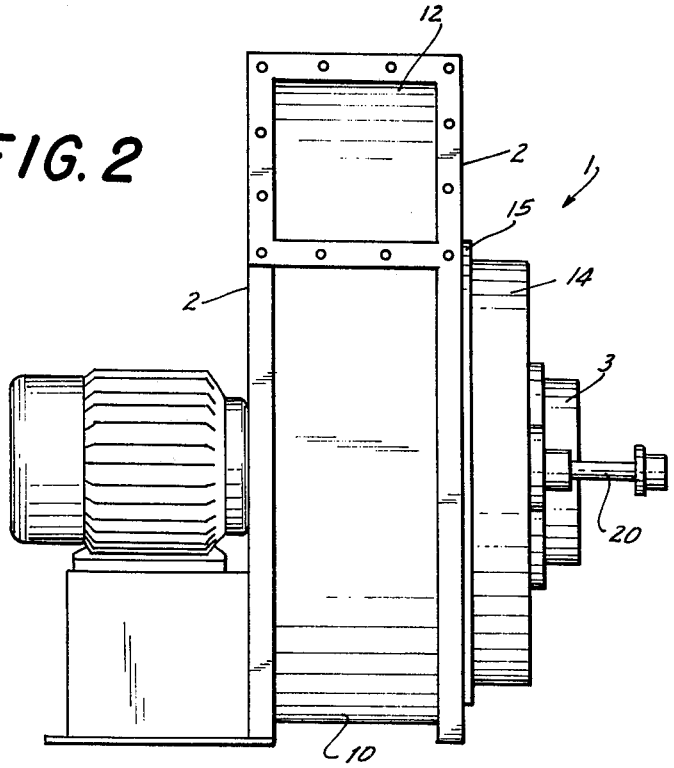

CENTRIFUGAL FAN

BACKGROUND OF THE INVENTION

This invention relates generally to centrifugal fans, and more specifically it relates to a centrifugal fan of the type which has an impeller wheel driven by a motor, the axis of the impeller being supported for rotation in a casing. The blades or passages of the impeller are arranged for centrifugally expelling a fluid towards an outlet thus forming a high pressure at a speed corresponding to the intended application of the fan.

Conventionally, a diffusing chamber is formed between the exit edges of the impeller and the inner surface of the casing. The casing has a tangentially directed passage expanding toward its outlet opening whereby the shape of the diffusing chamber depends on the efficiency of the impeller when the discharged fluid approaches the outlet opening. In the proximity of the outlet opening, the expansion of the chamber is designed such as to provide optimum velocity and pressure of the discharge fluid so that the efficiency of the fan is improved and has its maximum effect.

The mechanical performance of the fan of this type is modified according to predetermined characteristics representing different modes of operation of the fan with respect to the given operational conditions such as the desired pressure and efficiency of the fan. Some characteristics are common to all centrifugal fans, namely the characteristic curve indicating the variation of working parameters of the fan with respect to different operational conditions.

In the known types of centrifugal fans, if the rotary speed of impeller is increased, for example in order to improve the efficiency and the static pressure, the mechanical efficiency remains substantially constant since even when the increase of the rotary speed of the impeller results in an improved performance, there is also an increase in the static pressure and in the absorbed power. Accordingly, the characteristic curves show that the efficiency remains substantially constant within very narrow limits. From the laws of hydrodynamics it can be deduced that this behavior of centrifugal fans results from the fact that once a diffusion chamber has been designed for a fixed operational condition, the geometry, characteristic layout and dimensions of the chamber do not allow changes because of the fixed construction of the housing.

SUMMARY OF THE INVENTION

It is, therefore, a general object of the present invention to overcome the aforementioned disadvantages.

More particularly, it is an object of the invention to provide an improved centrifugal fan which makes it possible to vary the geometry and the size of the diffusing chamber.

Another object of this invention is to provide such an improved centrifugal pump whose functional parameters can be conveniently controlled.

In keeping with these objects, and others which will become apparent hereafter, one feature of the invention resides, in a centrifugal fan of the above-described type, in a combination which comprises a fan casing defining a substantially cylindrical jacket with a tangentially directed outlet duct and lateral walls, one of the walls including a tubular inlet duct partially projecting into the casing, an impeller supported for rotation in the casing opposite the end opening of the inlet duct, and an axially displaceable tubular partition coaxially surrounding the inlet duct and adjustably protruding into the casing toward the face of the impeller to define therewith a variable gap connecting an adjustable diffusing antichamber resulting in the casing between the displaceable tubular partition and the inlet duct, to a diffusing main chamber resulting between the displaceable tubular partition and the cylindrical jacket. The axis of rotation of the impeller is in alignment with the center axis of the fluid inlet duct. The outwardly projecting part of the tubular partition is enclosed in an annular envelope formed around the outwardly projecting part of the inlet duct and being hermetically connected to the one lateral wall to accommodate the movable partition. The variable diffusion chamber is limited by the face of the impeller, the inwardly projecting portion of the fluid inlet duct and the inwardly projecting portion of the movable partition which can axially be displaced into a closing position in close proximity to the face of the impeller and an open position remote from the impeller face.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view of a centrifugal fan according to this invention;

FIG. 2 is a front elevational view of the fan of FIG. 1;

DESCRIPTION OF THE PREFERRED EMBODIMENTS

Figure 3:
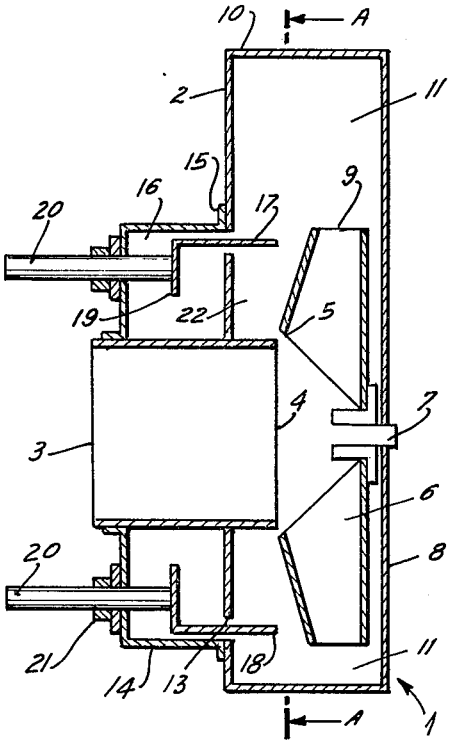
FIG. 3 is a sectional top view of the fan of FIG. 1 taken along the axle of the impeller.

Referring first to FIGS. 1–4, the fan of the invention comprises a casing 1 having a cylindrical or scroll-shaped jacket with a tangentially directed outlet duct and two plane and parallel side walls 2. One of the side walls is formed with a transverse tubular duct 3 forming an axial inlet of ambient fluid. The tubular duct 3 projects partially into the interior of casing 1 and faces the inlet edges 5 of blades of a centrifugal impeller or fan wheel 6 which is rotated on a driving shaft 7, the axis of which coincides with the central axis of tubular duct 3. The drive shaft 7 is supported for rotation in a bearing mounted on the other lateral wall 2. The diameter of the fan wheel 6 exceeds the diameter of the inlet duct 3. The outlet outer edges 9 of impeller 6 define with the jacket 10 of the casing 1 a main diffusion space 11 which can be varied between a minimum volume and a maximum volume relative to the outlet portion 12.

According to this invention, the lateral wall 2 at the inlet side of the fan has an annular slot 13 extending concentrically to the central axis of the tubular inlet duct 3 and this slot is hermetically enclosed against the ambient atmosphere by a cylindrical envelope 14 surrounding the outwardly projecting portion of the duct 3. The envelope 14 is attached to the wall 2 by screws 15 and by a sealing ring, and to the duct 3 it is hermetically secured by welding, for instance. The annular space 16 in envelope 14 contains an axially movable cylindrical partition 17 which projects through the annular slot 13 towards the outlet edges 9 of the fan wheel 6. As seen from FIG. 3, the axially adjustable partition 17 is concentric with the tubular duct 3 and thus with the axis of the driving shaft 7 of impeller 6. The annular base of envelope 14 is provided at each side of driving shaft 7 with sealing supports 21 for guiding control rods 20 projecting from the outside into the interior of the annular space 16 and being connected to the cylindrical partition 17 by means of radial extension 19. The axially displaceable cylindrical partition 17 may thus be axially displaced by moving the rods 20 between a closing position in which the rim 18 of partition 17 is situated a short distance from the outlet edges 9 of impeller blade 6, and an opening position wherein the rim 18 is spaced apart at a larger distance from the outer blades 9 so that a wide gap is established between the main diffusion space 11 and the intermediate annular space 22 formed between the central portion of impeller 6, the annular wall portion between the gap 13, the periphery of the tubular duct 3 and the inwardly projecting portion of the cylindrical partition 17.

This interspace 22 forms an adjustable diffusing antechamber, the function of which in the overall operation of the centrifugal fan of this invention will be described in more detail hereinafter.

Figure 5:
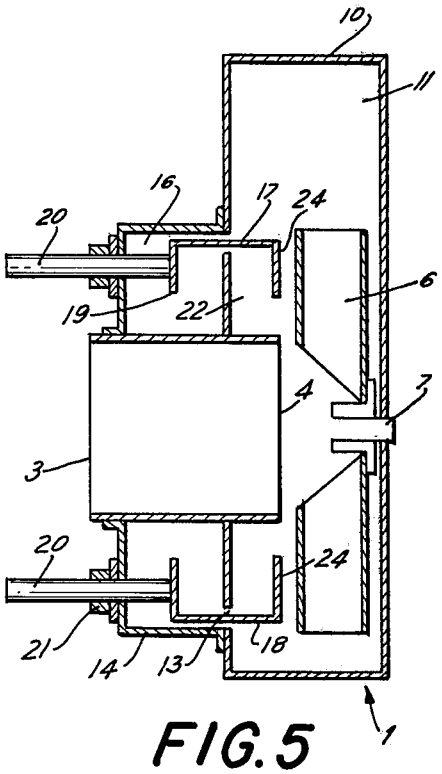
FIG. 5 is a sectional top view of a modification of the fan of FIG. 3.
Figure 4:
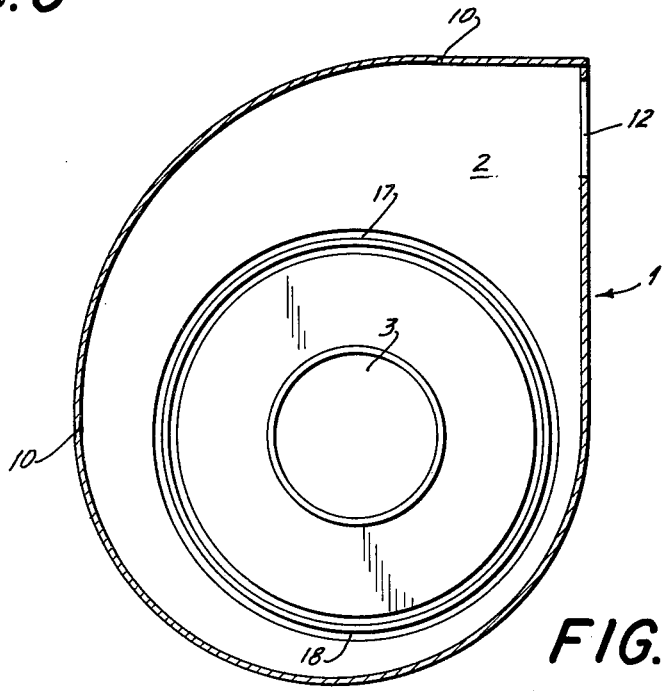
FIG. 4 is a sectional side view of the fan of this invention taken along the line A—A in FIG. 3.

FIG. 5 shows a modification of the structure of the centrifugal fan of FIG. 3 in which the fan wheel has blades, the front edges of which extend parallel to the interior rim 4 of the inlet duct 3 so that the shape of the impeller or fan wheel 6 is substantially cylindrical whereby the slanted blade edges in the central range of the fan wheel face the duct 3. In this embodiment, the interior rim 18 of the cylindrical partition 17 is provided with a radial, ring-shaped wall portion 24 directed inwardly parallel to the radial edges of blades 6. The gap between the annular wall portion 24 and the face of the impeller 6 define the variable gap connecting the main diffusion chamber formed around the inner periphery of the casing 1, to the diffusion antechamber resulting between the projecting outer surface of the tubular duct 3 and the axially displaceable cylindrical partition 17.

Figure 6:
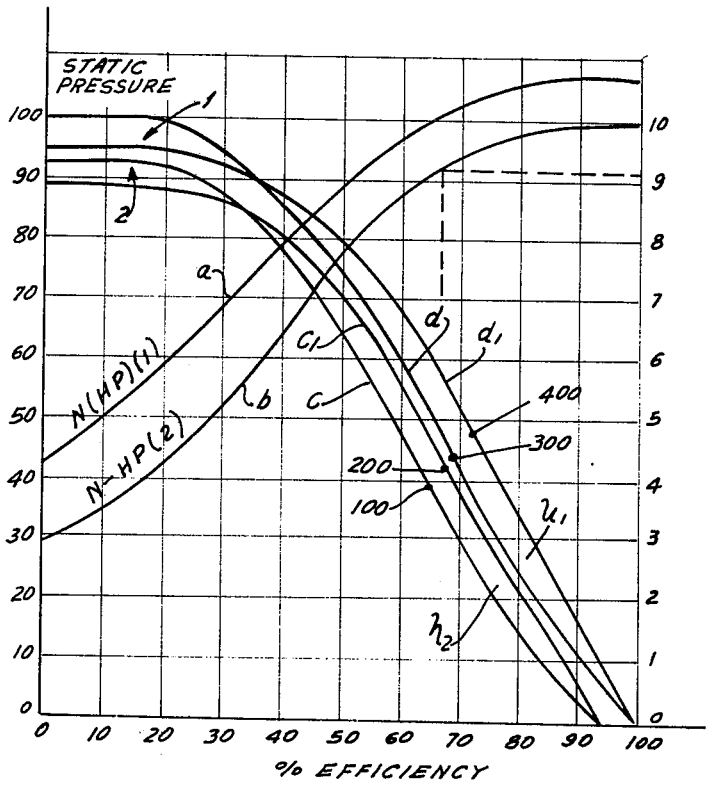
FIG. 6 is a plot of characteristics of the fan of this invention.

FIG. 6 illustrates characteristic curves A and B representing, respectively, the relation between horsepowers on the axle 7 of the fan wheel for two values of the rotational speed differing approximately by 6%, versus percentages of efficiency. In the plot diagram, the horsepowers are indicated on the ordinate at the right of the chart and the abcissa indicates the percentages of the efficiency.

Curves C and C1, plot the characteristics of variation of static pressure in percents versus the efficiency for the same rotational speeds of the fan wheel as that of the curves A and B. The static pressure is measured on the ordinate at the left of the chart.

All these curves are derived from tests performed on a prototype of a centrifugal fan of this invention and reflect exactly the behavior of the novel structure in comparison with conventional centrifugal fans of this type.

In the centrifugal fan designed according to this invention, the change resulting from the corresponding increase of rotation speed is as follows: Starting from the value 100, the space of the antechamber 22 is adjusted by axially displacing the cylindrical partition 17 so that at the point 200 the following values be reached:

$$Q200=67.8 \quad P200=43.2 \text{ and } N200=9.4.$$

Now if the velocity is increased and brought to $N_1$ which differs from $N_2$ as has been mentioned above by 6%, so at the point 300 the resulting values are $$Q300=68 \quad P300=43.5 \text{ and } N300=9.19.$$

The dimensions of the antechamber are increased such that at the point 400 the values are $$Q400=71.5 \quad P400=48 \text{ and } N400=10.40$$

Now it is found that the centrifugal fan according to this invention achieves a 3.7% higher efficiency with a 6.6% higher pressure and 4% more power.

In computing the mechanical efficiency on the basis of dimensional values, there results in the case of the conventional centrifugal fan $$n\uparrow_{00} = \frac{65 \times 40 = 28.2}{92} \quad n\uparrow_{00} = \frac{68.9 \times 45}{10.95} = 28.28$$

This result shows that there is no appreciable increase in the efficiency while in the case of the centrifugal fan according to the invention $$n\uparrow_{00} = \frac{65 \times 40}{92} = 28.2 \quad n\uparrow_{00} = \frac{71.5 \times 48}{114} = 30.10$$

The increase in the efficiency is approximately 6.7%.

When now the results of the centrifugal fan of this invention are expressed in an exponential form, the relationship between the efficiencies, pressure and powers and the rotational speeds corresponding thereto, there results $$\frac{Q^*}{Qi} = \left(\frac{nf}{nf}\right)^{1.1}; \frac{Pf}{Pi} = \left(\frac{nf}{ni}\right)^{3}; \frac{Nf}{Ni} = \left(\frac{nf}{ni}\right)^{3.4}.$$

This expression demonstrates that the function of the centrifugal fan of this invention does not follow the performance characteristics of conventional centrifugal fans.

It will be understood that each of the elements described above, or two or more together, may also find a useful application in other types of constructions differing from the types described above.

While the invention has been illustrated and described as embodied in a centrifugal fan, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A centrifugal fan, comprising a casing defining a substantially cylindrical jacket having a tangentially directed outlet duct and lateral walls, one of said walls being formed with a tubular inlet duct partially projecting into the casing; an impeller supported for rotation in said casing opposite the opening of said inlet duct, the diameter of said impeller exceeding the diameter of said inlet duct; and axially adjustable tubular partition means passing through said one wall around said inlet duct, said tubular partition means being spaced apart from the periphery of said inlet duct to define therewith an annular diffusing antechamber communicating via a variable gap with the main diffusing chamber formed between said jacket and the periphery of said impeller.

2. A centrifugal fan, comprising a casing defining a substantially cylindrical jacket having a tangentially directed outlet duct and lateral walls, one of said walls being formed with a tubular inlet duct partially projecting into the casing; an impeller supported for rotation in said casing opposite the opening of said inlet duct, the diameter of said impeller exceeding the diameter of said inlet duct; adjustable partition means disposed in said casing around said inlet duct to define an adjustable diffusing antechamber communicating via a variable gap with the main diffusing chamber formed between said jacket and the periphery of said impeller; said adjustable partition means including an annular slot formed in said one lateral wall around said tubular duct, an axially displaceable tubular member projecting through said annular slot into the interior of said casing, an annular envelope hermetically surrounding a space around the outer portion of said tubular inlet duct and being sealingly secured to said one lateral wall above said annular slot, to accommodate the outwardly projecting portion of said axially displaceable tubular member, and control means secured to said tubular member and projecting axially from said annular envelope to axially displace said tubular member between an open position remote from the face of said impeller and a closed position in close proximity to the outlet edges of said impeller.

3. A centrifugal fan as defined in claim 2, wherein said impeller has blades defining inlet edges sloping approximately from the rim of said tubular inlet duct toward the axis of rotation of the impeller, and outlet edges sloping from the rim of said inlet duct toward the other lateral wall of said casing.

4. A centrifugal fan as defined in claim 3, wherein the diameter of said axially displaceable tubular member corresponds substantially to the diameter of said impeller.

5. A centrifugal fan as defined in claim 2, wherein the outlet edges of the blades of the impeller are arranged in a plane parallel to the lateral wall of the casing, the rim of said axially displaceable tubular member being provided with an annular wall portion arranged in a plane parallel to said lateral walls.

* * * * *